United States Patent [19]

Harper et al.

[11] Patent Number: 4,716,692

[45] Date of Patent: Jan. 5, 1988

[54] LOCKING SYSTEM FOR INTERCONNECTING PANELS

[75] Inventors: Thomas Harper, Archdale; James Langham, High Point; Francis J. Idol, Kernersville, all of N.C.

[73] Assignee: Alma Desk Company, High Point, N.C.

[21] Appl. No.: 947,596

[22] Filed: Dec. 30, 1986

[51] Int. Cl.[4] ..... E04B 2/78

[52] U.S. Cl. ..... 52/36; 52/239; 52/241; 52/586

[58] Field of Search ..... 52/36, 239, 241, 586, 52/242, 275, 220, 221, 288, 465, 582

[56] References Cited

U.S. PATENT DOCUMENTS

| | | | |
|---|---|---|---|
| 3,425,171 | 2/1969 | Propst et al. | 52/239 |
| 3,430,997 | 3/1969 | Propst et al. | 52/239 |
| 3,713,257 | 1/1973 | Beavers | 52/36 |
| 3,766,696 | 10/1973 | Totoonchie | 52/241 |
| 3,866,370 | 2/1975 | Guarino et al. | 52/241 |
| 3,990,204 | 11/1976 | Haworth et al. | 52/239 |
| 4,035,972 | 7/1977 | Timmons | 52/241 |
| 4,047,342 | 9/1977 | Boulva | 52/239 |
| 4,067,165 | 1/1978 | Timmons | 52/585 |
| 4,120,124 | 10/1978 | Temple et al. | 52/36 X |
| 4,204,375 | 5/1980 | Good | 52/239 |
| 4,269,005 | 5/1981 | Timmons | 52/36 |
| 4,497,148 | 2/1985 | Lopez | 52/239 X |
| 4,545,168 | 10/1985 | Dalton, Jr. | 52/588 |
| 4,567,698 | 2/1986 | Morrison | 52/36 |
| 4,571,907 | 2/1986 | DeFouw et al. | 52/239 |
| 4,601,137 | 7/1986 | Bates | 52/239 X |

*Primary Examiner*—J. Karl Bell

*Attorney, Agent, or Firm*—Bell, Seltzer, Park & Gibson

[57] ABSTRACT

An arrangement for interconnecting wall panels of corresponding construction with one another to form walls of predetermined size and orientation is disclosed. The arrangement comprises a series of spaced apart parallel channels in the vertical sides of the wall panels; outwardly and upwardly extending fingers along each vertical side of each of the wall panels and positioned between the parallel channels; a columnar vertical standard which is received between the respective vertical sides of the adjoining wall panels and which column includes a plurality of spaced apart parallel vertical flanges which are of a size and spacing for being engagingly received in the channels; and parallel sets of vertical web members positioned at locations along the columnar standard which correspond to the location of the upwardly facing fingers along each vertical side of the adjoining wall panels. The vertical web members are restingly received by the fingers so that the engagement of the flanges of the columnar standard with the channels on the adjacent wall panels stabilizes the adjoining wall panels against torsional movement therebetween and the engagement of the fingers with the vertical web members interconnects the adjoining wall panels and stabilizes them against movement apart from one another in a direction parallel to their vertical faces.

21 Claims, 8 Drawing Figures

LOCKING SYSTEM FOR INTERCONNECTING PANELS

FIELD OF THE INVENTION

The present invention relates to office partition systems, and particularly to arrangements for interlocking vertical wall-like panels to one another to form various types of office work areas.

BACKGROUND OF THE INVENTION

In recent years, it has become increasingly popular to form office-like work areas in large rooms by partitioning the large rooms into small areas using upright partitions. Typically, such partitions are high enough to provide visual privacy when persons therein are seated or standing, but generally extend to less than ceiling height.

One of the desirable features of such systems is their flexibility, i.e. many can be disassembled, rearranged and reassembled as the requirements of a particlar office environment change from time to time.

Therefore, those systems which are most flexible are most advantageous. Factors which make such systems more or less flexible include the mechanical complexity of assembly and disassembly, the number of parts which must be manipulated, and the degree to which the panels themselves must be physically moved during their rearrangement. For example, disassembly of some systems requires that the individual panels be moved to such an extent that the presence of adjacent office floors, ceilings and walls may hamper or even preclude disassembly. Obviously, a system which requires a large volume of space to make small changes will be disadvantageous in many environments.

Additionally, as is evident from review of patent references in this area, many such office partition systems are assembled using a bewildering amount and complexity of individual parts and therefore suffer from the concurrent disadvantages of being both hard to keep track of and difficult to assemble.

Accordingly, it is an object of the invention to provide a locking system for interconnecting wall panels which is characterized by a reduced number of individual component parts.

It is another object of this invention to provide a system for interconnecting wall panels which can be easily assembled and disassembled without a plurality of small mechanical fasteners such as screws.

It is a further object of this invention to provide a system for interconnecting wall panels which provides locking stability in horizontal, vertical and torsional fashion.

It is yet another object of this invention to provide a panel system which includes raceway portions for channeling wiring and the like within the system.

SUMMARY OF THE INVENTION

The present invention is a locking system for interconnecting wall panels of corresponding construction with one another to form walls of predetermined size and orientation. The wall panels are generally rectangular in shape and are defined by opposing vertical sides, opposing horizontal ends and opposing vertical faces. The locking system comprises a plurality of spaced apart parallel channels which extend inwardly from the respective vertical sides of each of the wall panels. A plurality of outwardly and upwardly extending fingers are positioned along each vertical side of each of the wall panels and between the spaced apart parallel channels. Each of the fingers thereby defines an upwardly facing slot between the finger and the respective vertical side. A columnar vertical standard is received between the respective vertical sides of adjoining wall panels and is adapted to selectively interconnect the adjoining wall panels. The columnar standard has a plurality of spaced-apart parallel vertical flanges connected to one another and a plurality of parallel sets of short vertical web members positioned between the flanges. The flanges are spaced apart a distance substantially similar to the distance between the channels in the vertical sides, and each flange has a width substantially similar to the width of the channels in the vertical sides so that the flanges can be engagingly received in the channels. The parallel sets of vertical web members are positioned at locations along the columnar standard which correspond to the locations of the upwardly facing slots defined by the fingers along each side of the adjoining wall panels. The vertical web members are restingly received in the slots so that one horizontal member from each set is received in a respective slot on the respective adjoining panel. In this manner, the engagement of the flanges of the columnar standard with the channels on adjacent wall panels stabilizes the adjoining wall panels against torsional movement, and the engagement of the fingers and the slots with the vertical web members interconnects the adjoining wall panels and stabilizes them against movement apart from one another in directions parallel to their vertical faces.

DESCRIPTION OF THE DRAWINGS

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments and wherein.

DETAILED DESCRIPTION

Figure 1:
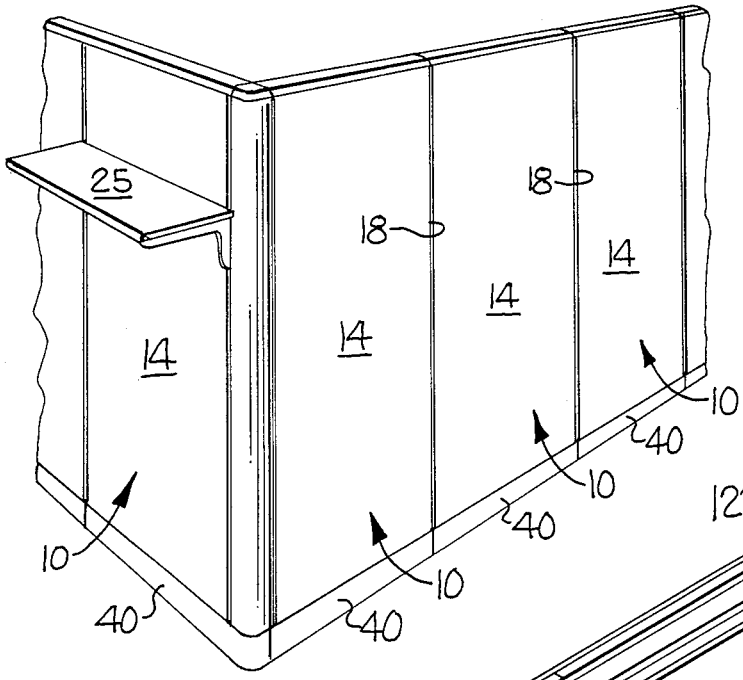
FIG. 1 is an overall perspective view of a portion of a partition wall formed of panels joined by the locking system of the present invention.

A perspective view of an office partition corner and a linearly extending wall formed from panels according to the present invention is shown in FIG. 1 with the panels themselves being broadly designated at 10.

Figure 2:
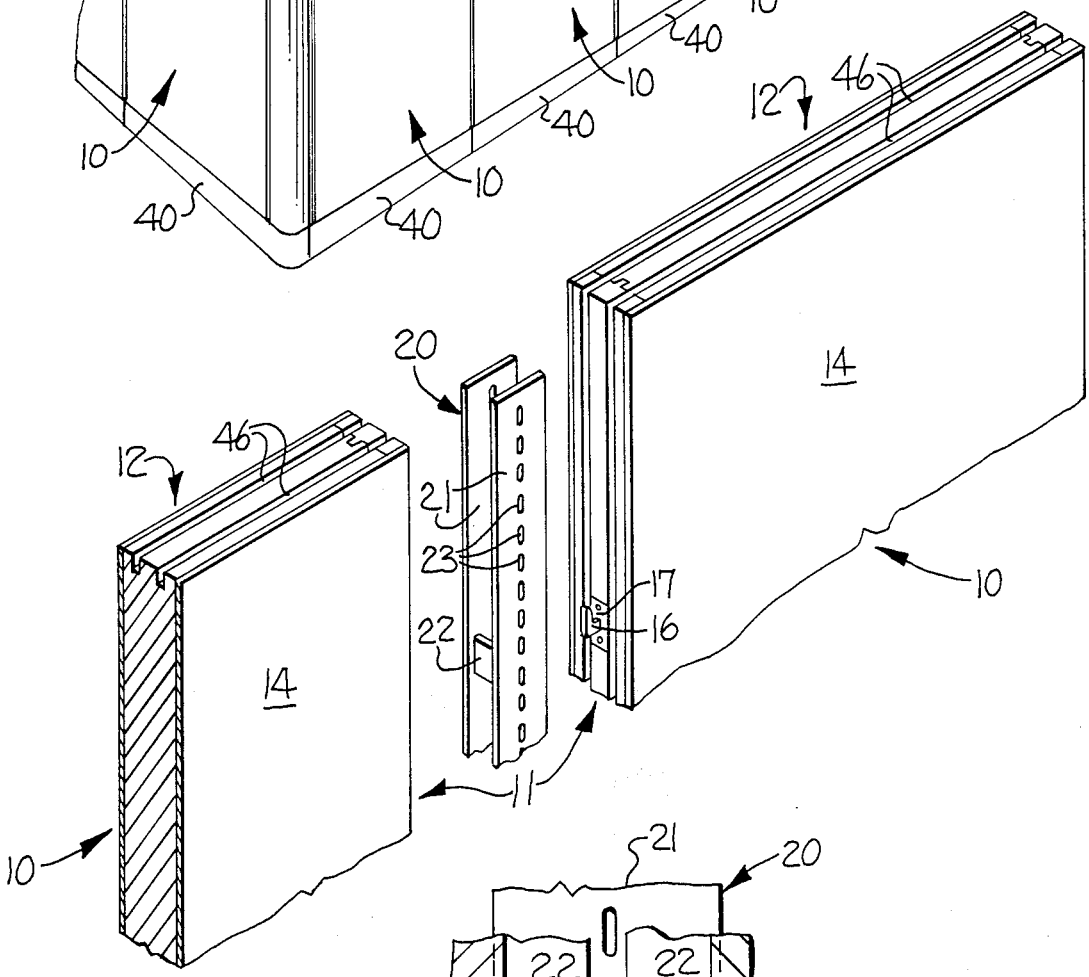
FIG. 2 is an enlarged, partially exploded perspective view of two wall panels and the columnar standard of the present invention.

FIG. 2 illustrates two abutting panels 10 in exploded end to end relationship to one another and also indicates that such panels are typically rectangular in overall shape and have opposing vertical sides broadly designated at 11, opposing horizontal ends designated 12 on the top and 13 on the bottom (FIG. 7), and opposing vertical faces 14.

As illustrated in FIG. 2, each of the panels 10 has a plurality of spaced apart parallel channels 15 extending inwardly from the respective vertical sides 11 of each of the wall panels 10. The embodiment illustrated in FIG. 2 includes a pair of such channels 15 which have generally rectangular cross sections and extend along the entire length of the vertical side 11.

Each vertical side 11 of each panel 10 also carries a plurality of outwardly and upwardly extending fingers 16 positioned along each vertical side 11 thereof, one of which is shown in the partial view of FIG. 2. The finger 16 is positioned between the channels 15 and further defines a generally U-shaped upwardly facing slot 17 between the finger 16 and the vertical side 11.

The locking system further includes a unitary columnar vertical standard broadly designated 20 in FIG. 2. The standard is adapted for being received between the respective vertical sides 11 of adjoining wall panels 10 and to selectively interconnect the wall panels to one another. In the illustrated and preferred embodiment of the invention, the columnar standard 20 is a non-load-bearing standard which greatly facilitates assembly and disassembly of the panel system, thereby increasing its flexibility. The columnar standard 20 has a plurality of spaced apart parallel vertical flanges 21 connected to one another and a plurality of parallel sets of short vertical web members 22 positioned between the flanges 21. As illustrated in FIG. 2, the columnar standard 20 is made up of a pair of rectangular flanges 21 which have a vertical dimension substantially greater than their length or width. The columnar standard also carries a number of sets of short rectangularly-shaped vertical web members 22, one of which members is shown in FIG. 2.

Figure 4:
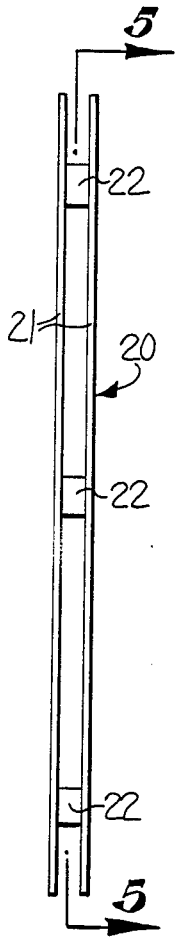
FIG. 4 is a plan view of the columnar standard of the present invention.
Figure 5:
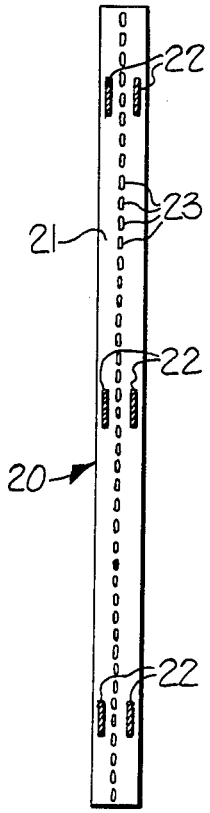
FIG. 5 is another, plan view of the columnar standard taken along lines 5—5 of FIG. 4.

FIGS. 4 and 5 show the columnar standard 20 in more complete detail. In the embodiment illustrated, the parallel sets of vertical web members 22 are arranged in parallel pairs and additionally serve to connect the flanges 21 to one another to form the columnar standard 20. The columnar standard 20 further includes a series of bracket receiving openings 23 positioned in the flanges 21 and into which various office furnishing accessories can be mounted, as for example the shelf brackets 24 and shelf 25 illustrated in FIG. 1. When the system is assembled, the relationship between the depth of the channels 15 and the width of the flanges 21 positions the openings 23 in a narrow, exposed, accessory-receiving gap 18 between adjacent panels 10 (FIG. 1).

As illustrated in the drawings and as particularly visible in FIG. 2, the flanges 21 are spaced apart from one another a distance which is substantially similar to the distance between the channels 15 in the vertical sides 11 of the panels. Additionally, each flange 21 has a width and rectangular cross-section substantially similar to the width and rectangular cross-section of the channels 15 so that the flanges 21 can be engagingly received in the channels 15. In such a position, the relationship between the flanges and the channels help prevent torsional movement between adjacent panels.

Figure 3:
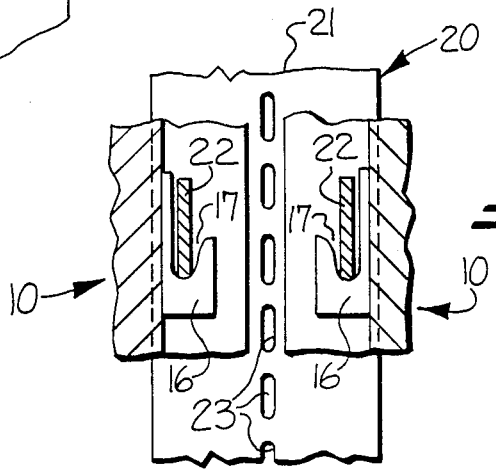
FIG. 3 is a partial cross-sectional view of a portion of the columnar standard, the fingers and slots, and the vertical web members restingly received therein and joining two panel portions together.

As set out earlier, a further advantage of the locking system is the interengagement between the vertical fingers 16, the slots 17 and the vertical web members 22. As best illustrated in FIGS. 2 and 3, the parallel sets of vertical web members 22 are positioned at locations along the columnar standard 20 which correspond to the locations of the upwardly facing slots 17 defined by the fingers 16 and the vertical sides 11 of each wall panel. As illustrated in FIG. 3, the vertical web members 22 are restingly received in the slots 17 so that one horizontal member 22 from each set is received in a respective slot 17 on a respective adjoining panel 10. Where a plurality of such engagements exist. The engagement stabilizes the adjoining wall panels against movement apart from one another in a direction parallel to their vertical faces. In the illustrated embodiment, three sets of parallel pairs of web members 22 interengage with three corresponding sets of fingers and slots on adjacent wall panels 10.

Additionally, the straightforward nature of the engagement of the fingers 16 and the web members 22 provides secure engagement independent of elaborate fastening hardware. The sets of fingers 16 and web members 22 are desirably the sole means of interconnecting adjacent wall panels 10. In short, adjoining wall panels 10 can be quickly and easily joined to one another simply by adding the columnar standard 20 therebetween and securing the panels to one another using the engagement between the flanges 21 and the channels 15 and between the web members 22 and the fingers 16. As stated earlier, the more simply and soundly such wall panels can be connected to one another, the more flexible and advantageous is their use in any given situation.

Figure 6:
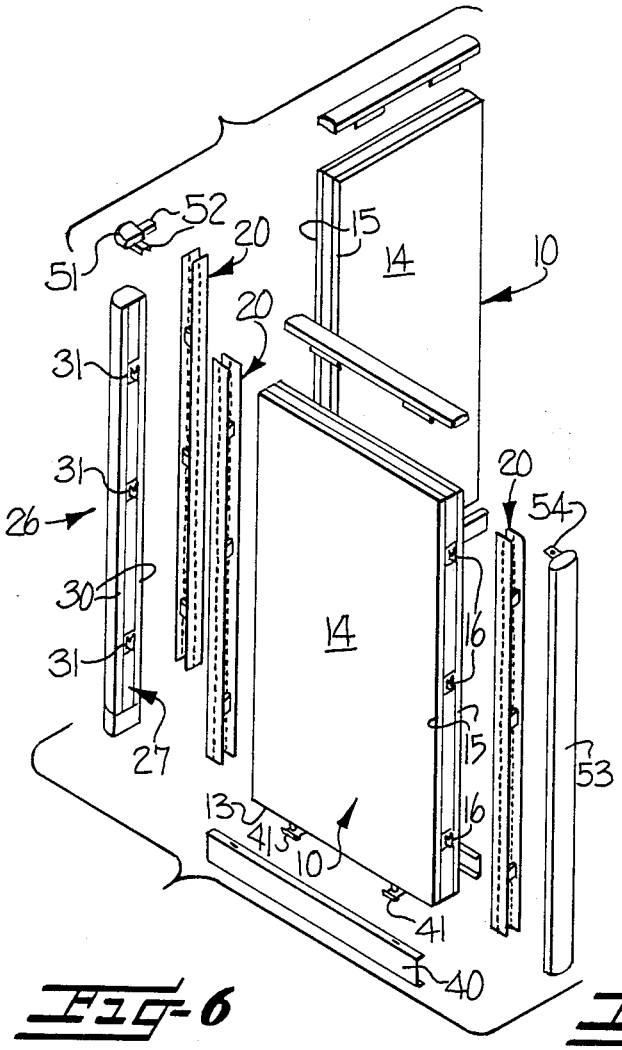
FIG. 6 is an exploded perspective view of the locking system showing two panels arranged end to end with one another and two arranged to form a corner with one another.

FIG. 6 illustrates the use of the locking system to form a 90° corner between two interconnecting wall panels 10. According to the invention, the wall panels which can be connected into corners are identical to those which can be linearly arranged as walls and all corresponding reference numerals will therefore be retained.

A corner formed according to the present invention includes a corner post broadly designated at 26. The post 26 has an overall height which is substantially equivalent to the height of the opposing vertical sides of the wall panels 10 which will make up the corner. The post has at least two vertical sides adjacent to one another one of which can be seen in FIG. 6 and is designated 27, and the other of which is perpendicular thereto. Each of the sides 27 include a pair of spaced apart parallel vertical channels 30 which extend inwardly from the two adjacent vertical sides 27 of the corner post 26. As can be observed in the drawings, the rectangular cross-section of the channels 30, the space between the channels 30 in the post 26 and the width of the channels themselves are all substantially similar to the cross-section of the channels 15, the space between the channels 15 in the panels 10, and the width of those channels.

It will be understood that any corner angle can be produced using the present invention the angle between the vertical sides 27 of the corner post 26 being the determining factor in the overall geometry of the corner.

In a manner similar to those positioned on the ends 11 of the panels 10, the sides 27 of the post 26 include three upwardly and outwardly extending fingers positioned along the respective adjacent vertical sides 27 and between the spaced apart channels 30. As in the case of the panels 10, the fingers 31 define generally U-shaped upwardly facing slots 32 between the fingers 31 and the vertical sides 27 of the post 26.

As further illustrated in FIG. 6, in preferred embodiments the positions of the fingers 31 on the post 26 are substantially the same as those of the fingers 16 on the vertical sides 11 of the panels 10. This relationship, and the relationship of the shape, size and position of the respective channels 15, 30 to one another, enables each respective panel 10 making up the corner to interlock with the corner post 26 in a manner directly analagous to that in which adjacent aligned panels interlock with one another to form linearly extending walls. Accordingly, the same columnar standard 20 which is used to interlock aligned panels in end to end fashion is likewise used to interlock panels to the corner post. As was the case in linear end to end alignment of the panels 10, the interengagement of the flanges 21 with the respective channels 15 and 30 and the engagement of the vertical web members 22 with the respective fingers 16, 31 and slots 17, 32 interconnects the wall panels with the corner post in a manner which is simple to assemble and yet stabilizes the wall panels at the corner against torsional movement and against movement away from the corner post in directions parallel to the respective vertical faces.

Figure 7:
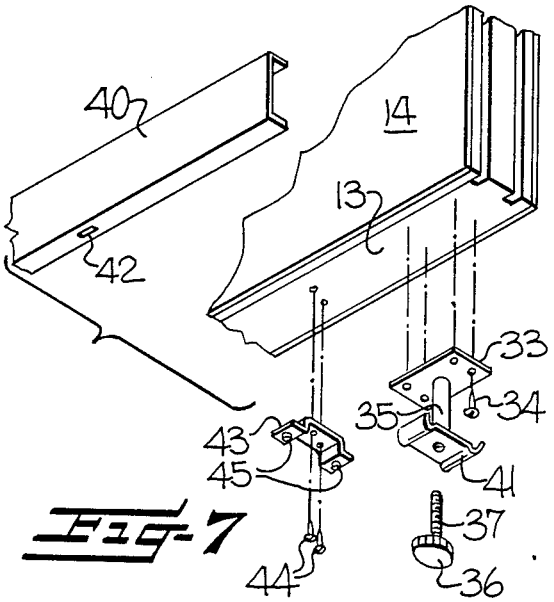
FIG. 7 is a partial exploded perspective view of lower portions of a panel according to the present invention and showing the means for supporting the panels on a floor.
Figure 8:
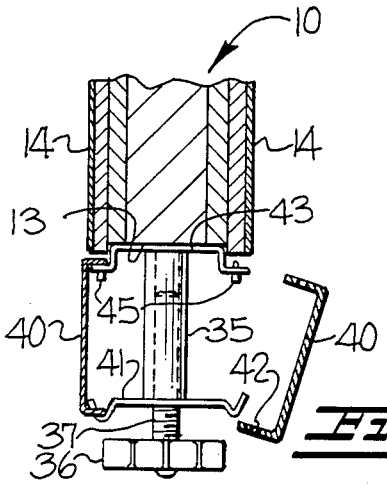
FIG. 8 is a partial cross-sectional view of the bottom portions of a panel and also showing the means for supporting the panels on the floor and forming a raceway between the panels and the floor.

As illustrated in FIGS. 7 and 8, preferred embodiments of the invention include a plurality of short vertical supports positioned on the bottom horizontal end 13 of each of the panels 10 which support the panel 10 a short distance above a floor. These short vertical supports include a rectangular bracket 33 fastened to the bottom horizontal end 13 of the panel 10. In the drawings, the bracket 33 is fastened to the bottom horizontal end 13 with several screws or nails, one of which is shown at 34.

A generally cylindrical support leg 35 depends downwardly from the bracket 33 to the floor and is connected to a circular-shaped foot 36 which is received against a floor. In order to adjust the position of the panel 10 with respect to a floor, the support leg 35 and the foot 36 include means for adjusting the vertical distance between the bracket 33 and the foot 36. In the illustrated embodiment the adjusting means comprises a threaded pin 37 which connects the foot 36 to the support leg 35.

With the panel 10 so supported above the floor, the invention also includes a pair of raceway panels 40 positioned coplanar with each respective vertical face 14 of the wall panels 10. The raceway panels 40 extend downwardly from the respective faces 14 between the panel 10 and the floor and thereby form an enclosed raceway beneath the wall panel 10. The raceway is bordered by the floor, the two raceway panels 40 and the bottom horizontal end 13 of the wall panel. Typically, such a raceway can carry and hide wiring for office equipment located adjacent or within partitions formed by the panels and locking system.

As illustrated in FIGS. 7 and 8, the support leg 35 and the bottom horizontal end 13 of the panel 10 both carry means for fastening the raceway panel to the support leg and the wall panel 10. As illustrated in the drawings, the lower end of support leg carries a rectangular catch plate 41 having downwardly protruding portions which frictionally engage lower portions of the raceway panel 40. In a preferred embodiment, the raceway panel 40 includes the small rectangular openings 42 for engaging the catchplate 41 and the means carried by the bottom horizontal end of the wall panel.

As further seen in FIGS. 7 and 8, the bottom horizontal end 13 of the wall panel 10 carries a separate rectangular bracket 43 fastened thereto by a pair of screws or nails 44. The bracket 43 carries small bullet catches 45, portions of which protrude upwardly from the bracket 43 and frictionally engage the openings 42 in the upper portions of the raceway panel 40. As best illustrated in FIG. 1, when a number of the panels 10 are joined to form a wall, the raceway panels form an aesthetically pleasing border between the panels 10 and the floor.

As a means of tying together the appearance of a partition system interlocked according to the present invention, means are provided for attaching finish molding to the various components. In a preferred embodiment, another pair of spaced apart parallel channels 46 extend linearly along and downwardly from the top horizontal end 12 of each of the wall panels 10. The channels 46 are illustrated in the most detail in FIG. 2, and their relationship to respective portions of finish molding 47 is best illustrated in FIG. 6. The channels 46 have generally rectangular cross-sections, and in the illustrated embodiment have the same spacing as the channels 15 in the vertical sides 11 and communicate therewith.

As illustrated in FIG. 6, the respective portions of finish molding 47 have downwardly depending flange-like legs 50 which are received in the spaced apart parallel channels 46 in the top horizontal end 12 of the wall panels 10. A similar small cap of molding 51 is illustrated in FIG. 6 as finishing the corner post 26 and includes its own set of downwardly depending legs 52 arranged at a 90° angle for being received in the channels 46 in the top ends 12 of the panels 10 which form the corner.

Finally, a portion of end molding 53 can be positioned adjacent one of the vertical sides of one of the wall panels 10 to finish it off. In the illustrated embodiment, the end molding 53 is engageable with one of the columnar posts 20 and has a small U-shaped bracket 54 for being received in the channels 46 in the top horizontal end 12 of the wall panel 10 to which it is adjacent. Although all of the molding illustrated in the drawings has a rounded appearance, it will be understood that a number of shapes and sizes of molding can be accomodated according to the present invention.

In the drawings and specification, there have been disclosed typical preferred embodiments of the invention and, although specific terms are employed, they are used in a generic and descriptive sense only and not for purposes of limitation, the scope of the invention being set forth in the following claims.

That which we claim is:

1. An arrangement for interconnecting wall panels of corresponding construction with one another to form walls of predetermined size and orientation, said wall panels being generally rectangular in overall shape and having opposing vertical sides, opposing horizontal ends and opposing vertical faces, said arrangement comprising:

a plurality of spaced apart parallel channels extending inwardly from the respective vertical sides of each of said wall panels;

a plurality of outwardly and upwardly extending fingers positioned along each vertical side of each of said wall panels and between said spaced apart parallel channels, each of said fingers defining an upwardly facing slot between said finger and said respective vertical side;

a columnar vertical standard for being received between the respective vertical sides of adjoining wall panels and adapted to selectively interconnect said adjoining wall panels, said columnar standard having a plurality of spaced apart parallel vertical flanges connected to one another and a plurality of parallel sets of short vertical web members positioned between said flanges;

said flanges being spaced apart a distance substantially similar to the distance between said channels in said vertical sides and each flange having a width substantially similar to the widths of said channels in said vertical sides for being engagingly received therein; and said parallel sets of vertical web members being positioned at locations along said columnar standard which correspond to the locations of said upwardly facing slots defined by said fingers along each vertical side of adjoining wall panels, said vertical web members being restingly received in said slots so that one vertical member from each set is received in a respective slot on respective adjoining panels, whereby the engagement of the flanges of the columnar standard with the channels on adjacent wall panels stabilizes the adjoining wall panels against torsional movement therebetween and the engagement of said fingers and slots with said vertical web members interconnects said adjoining wall panels and stabilizes said adjoining wall panels against movement apart from one another in a direction parallel to their vertical faces.

2. A locking system according to claim 1 wherein said plurality of channels comprises a pair of channels extending inwardly from the respective vertical sides of each of said wall panels.

3. A locking system according to claim 1 wherein said plurality of flanges of said columnar standard comprises a pair of flanges.

4. A locking system according to claim 1 wherein said parallel sets of short vertical web members comprise parallel pairs of short vertical web members.

5. A locking system according to claim 1 wherein said parallel sets of short vertical web members connect said flanges to one another.

6. A locking system according to claim 1 wherein said unitary columnar standard is a non-loadbearing standard.

7. A locking system for interconnecting wall panels of corresponding construction with one another to form walls of predetermined size and orientation, said wall panels being generally rectangular in overall shape and having opposing vertical sides, opposing top and bottom horizontal ends and opposing vertical faces, said locking system substantially eliminating the need for threaded connections or other tool-intensive fasteners between panels, said locking system comprising:

a pair of spaced apart parallel channels extending inwardly from the respective vertical sides of each of said wall panels;

a plurality of outwardly and upwardly extending fingers positioned along each vertical side of each of said wall panels and between said spaced apart parallel channels, each of said fingers defining an upwardly facing slot between said finger and said respective vertical side;

a non-loadbearing unitary columnar vertical standard for being received between the respective vertical sides of adjoining wall panels, said columnar standard having two spaced apart parallel vertical flanges and a plurality of parallel pairs of short vertical web members positioned between said vertical flanges and connecting said flanges to one another;

said flanges being spaced apart a distance substantially similar to the distance between said channels in said vertical sides and each flange having a width substantially similar to the widths of said channels in said vertical sides for being engagingly received therein; and said parallel pairs of web members being positioned at locations along said columnar standard which correspond to the locations of said upwardly facing slots defined by said fingers along each vertical side of adjoining wall panels, said web members being restingly received in said slots so that one web member from each pair is received in a respective opposite slot on respective adjoining panels, whereby the engagement of the flanges with the channels on adjacent wall panels stabilizes the adjoining wall panels against torsional movement therebetween and the engagement of said fingers and slots with said web members interconnects said adjoining wall panels stabilizes adjoining wall panels against movement apart from one another in a direction parallel to their vertical faces.

8. A locking system according to claim 7 further comprising a pair of spaced apart parallel channels extending downwardly from the top horizontal end of each of said wall panels.

9. A locking system according to claim 8 further comprising a portion of finish molding carried by the top opposing end of at least one of said wall panels, said portion of finish molding having downwardly depending flange-like legs for being received in said spaced apart parallel channels in said top horizontal end of said wall panel.

10. A locking system according to claim 7 further comprising a plurality of short vertical supports positioned on the bottom horizontal end of each of said panels for supporting said panel a short distance above a floor.

11. A locking system according to claim 10 further comprising a pair of raceway panels positioned coplanar with each respective vertical face of said wall panel and extending downwardly therefrom between said panel and the floor to thereby form an enclosed raceway beneath said wall panel, said raceway being bordered by the floor, the two said raceway panels, and the bottom horizontal end of said wall panel.

12. A locking system according to claim 10 wherein said short vertical supports further comprise:

a bracket fastened to said bottom horizontal end of said wall panel;

a support leg depending downwardly from said bracket towards the floor; and a foot connected to and positioned below said support leg for being received against the floor.

13. A locking system according to claim 12 wherein said support leg and said foot include means for adjusting the vertical distance between said bracket and said foot for thereby adjusting the position of said wall panel with respect to the floor.

14. A locking system according to claim 13 wherein said adjusting means comprises a threaded connection between said foot and said support leg for adjusting the vertical position of said foot and said leg with respect to one another, thereby adjusting the position of said wall panel with respect to the floor.

15. A locking system according to claim 7 further comprising:

a bracket fastened to said bottom horizontal end of said wall panel;

a support leg depending downwardly from said bracket towards a floor;

an adjustable foot threadably connected to and positioned below said support leg for being received against the floor and whereby said threaded connection between said foot and said support leg provides means for adjusting the vertical position of said foot and said leg with respect to one another, thereby adjusting the position of the wall panel with respect to the floor;

a pair of raceway panels positoned coplanar with each respective vertical face of said wall panel and extending downwardly therefrom between said panel and said floor to thereby form an enclosed raceway beneath said wall panel, said raceway being bordered by the floor, said raceway panels, and said bottom horizontal end of said wall panel;

means carried by said support leg for fastening said raceway panel to said support leg; and means carried by said bottom horizontal end of said wall panel for engagingly receiving said raceway panels, whereby the raceway panels may be fastened to the bottom of said wall panels in a manner which prevents them from becoming dislodged.

16. A locking system according to claim 15 wherein said raceway fastening means carried by said support leg comprises a catch plate carried on lower portions of said support leg.

17. A locking system according to claim 15 wherein said raceway receiving means carried by said wall panel comprises a plurality of bullet catches carried by a bracket attached to said bottom horizontal end of said wall panel.

18. A locking system for forming an angled corner from two interconnecting wall panels of corresponding construction with one another, said wall panels being generally rectangular in overall shape and having opposing vertical sides, opposing top and bottom horizontal ends, and opposing vertical faces, said arrangement comprising:

a corner post of an overall height substantially equivalent to the height of said opposing vertical sides of said wall panels, and having at least two vertical sides adjacent one another, each of said adjacent sides including a pair of spaced apart parallel vertical channels extending inwardly from said two adjacent vertical sides of said corner post;

a pair of spaced apart parallel vertical channels extending inwardly from the respective vertical sides of each of said wall panels, said vertical channels in said vertical sides of said wall panels being spaced apart a distance substantially similar to that of said vertical channels in said corner support post;

a plurality of outwardly and upwardly extending fingers positioned along said respective adjacent vertical sides of said corner post and between said spaced apart parallel vertical channels in said vertical sides of said post, each of said fingers defining an upwardly facing slot between said finger and said respective vertical side of said post;

a plurality of outwardly and upwardly extending fingers positioned along each vertical side of each of said wall panels and between said spaced apart parallel vertical channels in said vertical sides of said wall panels, each of said fingers defining an upwardly facing slot between said finger and said respective vertical side of said wall panel;

a pair of unitary columnar vertical standards for being received between each respective vertical side of each of said wall panels and said corresponding respective vertical side of said corner post, each of said columnar standards having two spaced apart parallel vertical flanges and a plurality of parallel pairs of short vertical web members positioned between said flanges and connecting said flanges to one another;

said flanges being spaced apart a distance substantially similar to the distance between said respective vertical channels in said vertical sides of said wall panels and said corner post, and each flange having a width substantially similar to the widths of each of said respective vertical channels for being engagingly received therein; and said parallel pairs of web members being positioned at locations along said columnar standard which correspond to the locations of said upwardly facing slots defined by said fingers along each vertical side of said wall panels and said corner post, and said web members being restingly received in said slots so that one web member from each pair is received in a respective opposite slot on said panel and said post, whereby the engagement of the flanges with the vertical channels on said wall panels and said corner posts stabilizes the wall panels against torsional movement with respect to said corner post, and the engagement of said fingers and said slots with said web members interconnects said wall panels with said corner posts and stabilizes said wall panels against movement apart from said corner post in directions parallel to the respective vertical faces.

19. A locking system according to claim 18 wherein said adjacent sides of said corner post which include said vertical channels are at substantially a 90° angle with respect to one another so that the corner formed from said interconnecting wall panels and said post is substantially a 90° corner.

20. A locking system according to claim 19 further comprising a pair of spaced apart vertical channels extending downwardly from the top horizontal end of each of said wall panels, and a generally L-shaped connector element positioned on said post and extending therefrom to each said top horizontal end, said connector element having a generally U-shaped cross section with a pair of downwardly depending legs which are engagingly received in said channels in said top horizontal ends of said wall panels.

21. A locking system according to claim 18 wherein the sides of said corner post which are not engaged by said wall panels carry a covering of finish molding.

* * * * *